United States Patent [19]

Groom

[11] 4,258,951

[45] Mar. 31, 1981

[54] COLLAPSIBLE CHAIRS AND WHEELCHAIRS

[75] Inventor: Simeon H. Groom, London, England

[73] Assignee: Lock Industrial Developments, Luxembourg, Luxembourg

[21] Appl. No.: 884,246

[22] Filed: Mar. 7, 1978

[30] Foreign Application Priority Data

Mar. 9, 1977 [GB] United Kingdom ..... 9997/77
Jun. 17, 1977 [GB] United Kingdom ..... 25498/77

[51] Int. Cl.[3] ..... A47C 4/00

[52] U.S. Cl. ..... 297/16; 297/19; 297/441

[58] Field of Search ..... 297/19, 16, 441, 440

[56] References Cited

U.S. PATENT DOCUMENTS

| | | | |
|---|---|---|---|
| 2,712,349 | 7/1955 | Le Voir | 297/441 |
| 3,310,340 | 3/1967 | Brewer et al. | 297/16 |
| 4,047,752 | 9/1977 | Rohr | 297/16 X |
| 4,065,172 | 12/1977 | Gawlinski | 297/19 |

FOREIGN PATENT DOCUMENTS

| | | | |
|---|---|---|---|
| 469976 | 4/1948 | Canada | 297/19 |
| 2045486 | 7/1971 | Fed. Rep. of Germany | 297/16 |
| 543180 | 5/1956 | Italy | 297/441 |

*Primary Examiner*—Roy D. Frazier
*Assistant Examiner*—Peter A. Aschenbrenner
*Attorney, Agent, or Firm*—Fidelman, Wolffe & Waldron

[57] ABSTRACT

A portable collapsible chair comprising two articulated assemblies connected by an elongated tubular support, one assembly forming the front of the chair comprising four arms pivotable from a folded position lying alongside the elongated tubular support to a position extending radially from a center bracket and the other assembly, forming the back of the chair, including an elongated tubular member with at least two support legs at its base and which are pivotable from a folded position lying alongside the elongated tubular support to an extended position projecting downwardly from the two tubular members. The chair may include wheels on the legs to convert it into a wheel chair.

18 Claims, 18 Drawing Figures

COLLAPSIBLE CHAIRS AND WHEELCHAIRS

This invention relates to a collapsible chair and more particularly to a portable chair which can be readily erected for use and thereafter folded in to a compact collapsed condition for easy carriage and storage.

A number of portable collapsible seats or chairs are already known the most common of which is the deckchair. However, in the collapsed or stored position these chairs have disadvantages in that they occupy a considerable storage space apart from which they are cumbersome to carry for any considerable distance and relatively heavy.

An aim of the present invention is to provide a collapsible chair which overcomes these disadvantages.

According to the present invention there is provided a portable collapsible chair comprising a bracing frame and a separate flexible seat in which the frame is readily pivotable from a folded position to an erected position for attachment of the flexible seat to support and brace the flexible seat clear of the ground surface on which the chair is supported.

Conveniently the bracing frame comprises two articulated assemblies connected by an elongated tubular support, one articulated assembly, forming the front of the chair, comprising four arms pivotable from a folded position lying alongside the elongated tubular support to an extended position where they extend radially from a centre bracket and the other assembly, forming the back of the chair, comprising an elongated tubular member and at least two support legs at the lower end thereof, which legs are pivotable from a folded position lying alongside the elongated tubular support to an extended position projecting downwardly from the two tubular members.

According to a modification of the present invention the legs of the bracing frame are provided with wheels to convert the chair into a wheel chair.

Conveniently, the four arms of the front articulated assembly are automatically moved to an erect position by an umbrella mechanism comprising a sleeve slidable along the elongated tubular support, and four struts connected one to each arm, each strut having universal joints at its free ends to connect it to the sleeve and arm respectively.

An embodiment of the invention will now be described, by way of example, with reference to the accompanying drawings, in which.

Figure 1:
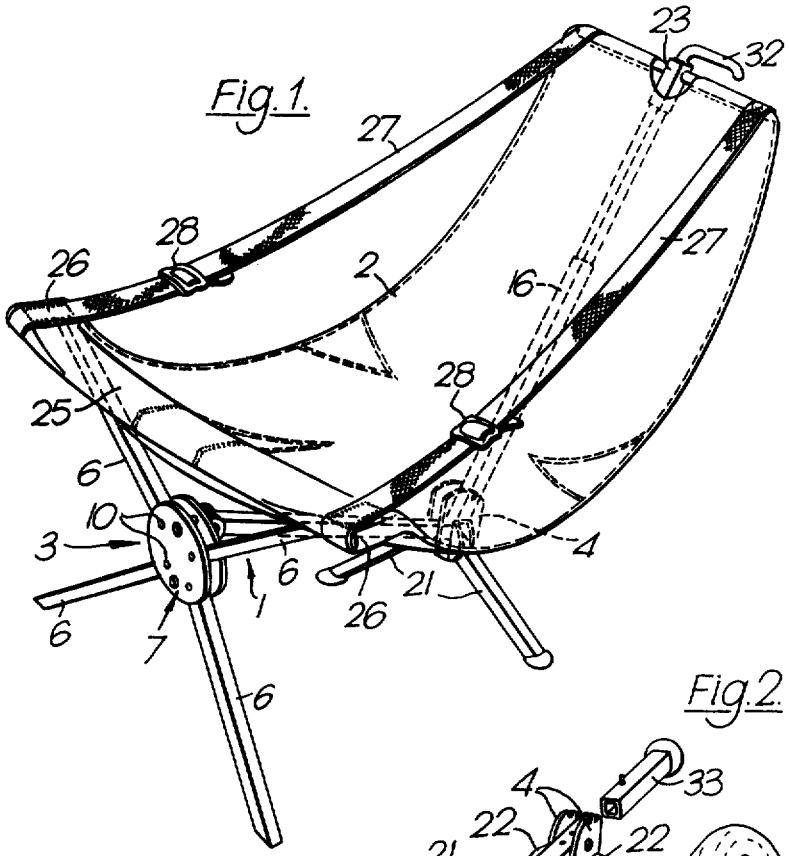
FIG. 1 is a perspective view of a collapsible chair, according to the present invention in the assembled position ready for use.

Referring now to the drawings in detail the portable collapsible chair comprises a bracing frame generally indicated at 1 and a flexible seat 2 of canvas or other suitable material. The bracing frame comprises two articulated assemblies, a front assembly 3 and a rear assembly 4. The front and rear assemblies are connected by an elongated tubular support 5.

Figure 6:
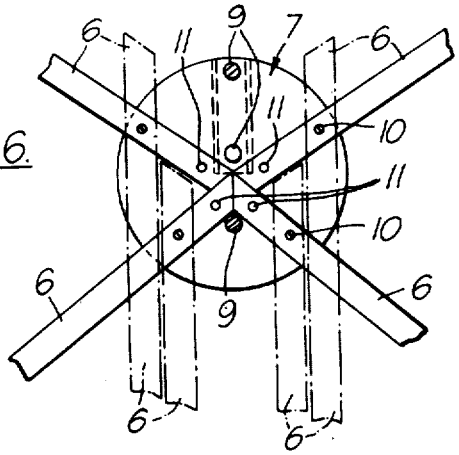
FIG. 6 is a detailed elevational view of the bracket of the front assembly partly in section.

The front articulated assembly, as shown in detail in FIG. 6, comprises four tubular arms 6 of rectangular tubular cross section which are pivoted to a bracket 7 comprising two circular plates 8 of sheet metal riveted together by three rivets 9. The arms are pivoted at points 10 so that they can be swung from a folded position; as shown in chain-dotted line in FIG. 6 to a radial position shown in full lines.

In their erected or radial position the arms 6 are located in position by spring loaded detents 11 which engage the circular plates 8.

Figure 5:
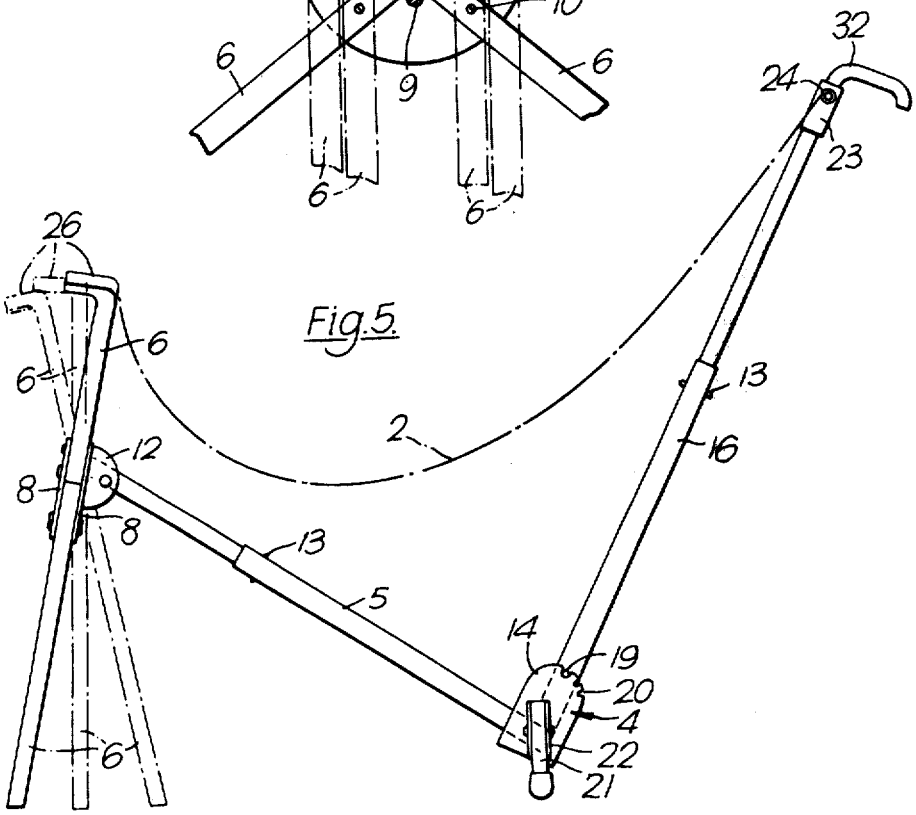
FIG. 5 is a side elevation of the bracing frame of FIG. 4 in its erected position.
Figure 8:
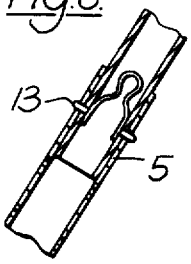
FIG. 8 is a fragmentary detailed view of the locking means of the telescopic elongated tubular member and the elongated tubular support.

At the rear of the articulated assembly 3 is a U-shaped bracket 12, see FIG. 5, which is riveted to the rear circular plate 8 and forms a pivot for one end of the elongated tubular support 5. The support 5 is formed from two lengths of metal tube of rectangular cross-section and are telescoped to allow for adjustment of the length of the support 5. The support can be fixed in one or more selected positions by a spring loaded catch 13 a detail of which is shown in FIG. 8.

Figure 7:
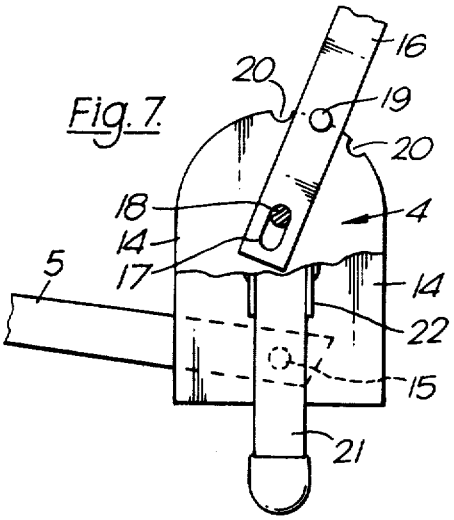
FIG. 7 is a detailed elevational view of the bracket at the rear assembly.

The rear articulated assembly 4 as shown in detail in FIG. 7, comprises a bracket including two metal plates 14 riveted together by rivets 15 and 18. The bracket forms an articulated joint for an elongated tubular member 16 and the elongated tubular member 5. The member 16 has a slot 17 at its lower end which is located on a rivet 18 and has a pin 19 which projects from each side of the member 16 so that they can be located in any one of three notches 20 formed in the arcuate surface of bracket plates 14. It will be seen that by lifting the member 16 the rivet 18 slides in the slot 17 and the pin can be located in any of the notches 20, to alter the angle of the member 16 relative to the support 5.

Figure 2:
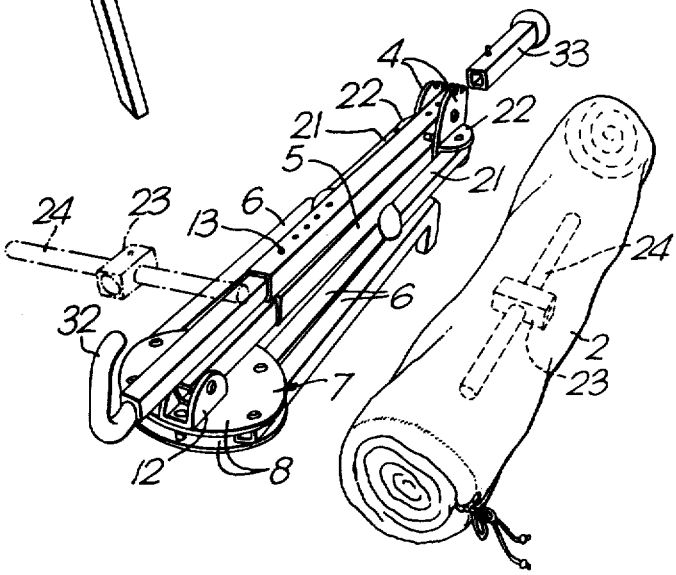
FIG. 2 is a perspective view of the collapsible chair of FIG. 1 in the folded position with the flexible seat removed and in its rolled up condition.

Secured at each side plate 14 of the bracket is a leg 21 pivoted in a U-shaped bracket 22. This bracket 22 has a slot engaging a rivet (not shown) which enables the respective leg to be lifted from its ground engaging position and pivoted to its stored position lying along side the support 5, see FIGS. 2 and 3.

The upper or free end of the member 16 has a removable cap 23 through which passes a rod 24 for supporting the upper end of the canvas flexible seat 2. The cap and rod can be removed from the member 16 and rolled up with the canvas seat 2 as shown in chain-dotted line in FIG. 2.

Figure 3:
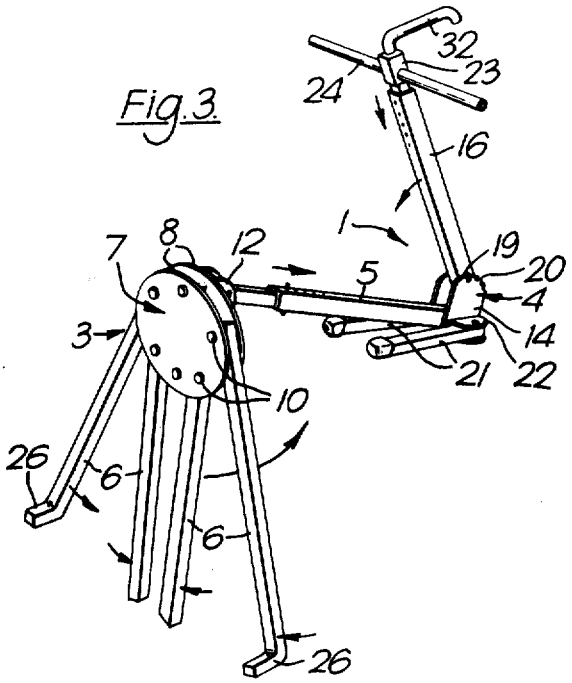
FIGS. 3 and 4 are perspective views of the bracing frame showing the folding sequence.
Figure 4:
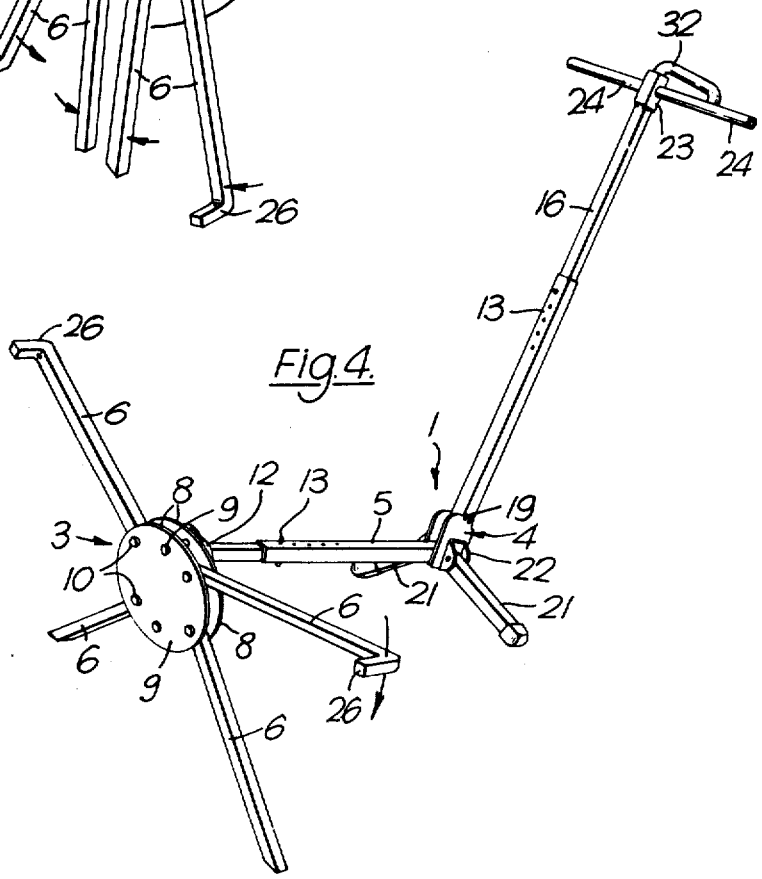

To erect the chair the flexible canvas seat 2 is unrolled from the bracing frame 1 and the frame is unfolded as shown in FIGS. 3 and 4. The front articulated assembly 3 can be set in any one of three positions as shown in FIG. 5. The support 5 is adjusted to its required length and locked in position. The member 16, which is also formed of two telescopic tubes is adjustable in length similarly to support 5 by a spring loaded clip 13. The extended member is arranged at the required angle by locating its lower end in one of the notches 20 and the two side legs are pivoted and locked in their ground engaging position.

The flexible canvas seat 2 is provided with a strip of reinforcing webbing 25 at its front edge formed with two pockets formed by stitching the canvas. These pockets are located on forwardly projecting handles 26 provided at the free ends of the two upper arms 6. These handles are also used to grip when the user wishes to get up from the sitting or reclining position. The cap 23, which is slipped into pockets formed in the opposite edge of the canvas, is located on the upper end of the member 16 forming a concave flexible seat. The sides of the canvas seat 2 are provided with arm rests 27 in the form of canvas strips which are stitched at their ends to the canvas, and can be adjusted by buckles 28.

It will be appreciated that the chair can be readily adjusted between an upright or a reclining position by lifting the member 16 and locating it in the required notch 20.

Figure 9:
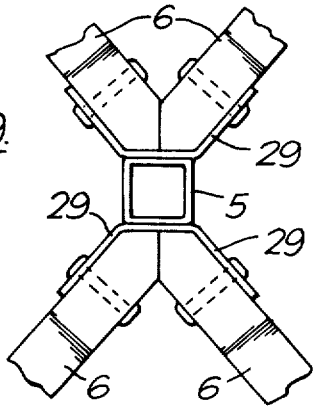
FIG. 9 is a modification of the joint of the front articulated assembly.

The articulation of the four arms 6 of the front assembly can be modified as shown in FIG. 9. In this construction the bracket 7 is omitted and the arms 6 are pivoted in pairs to two brackets 29. The brackets 29 are secured directly to one end of the support 5.

Figure 10:
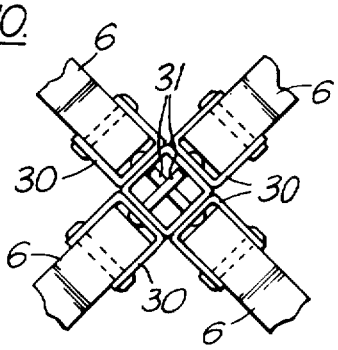
FIG. 10 is a further modification of the joint of the front articulated assembly.

Another modified construction of the joint for the front assembly is illustrated in FIG. 10 where the bracket 7 is again omitted and each of the four arms 6 are pivotably mounted on U-shaped brackets 30 secured to the support 5 by rivets or bolts 31.

Various other modifications may be made to the invention for example the elongated support member 16 may be provided when in its folded position with a handle 32 at one end and a removable foot 33 at its other end enabling it to be easily carried and even used as a support when walking with the collapsed chair.

Figure 11:
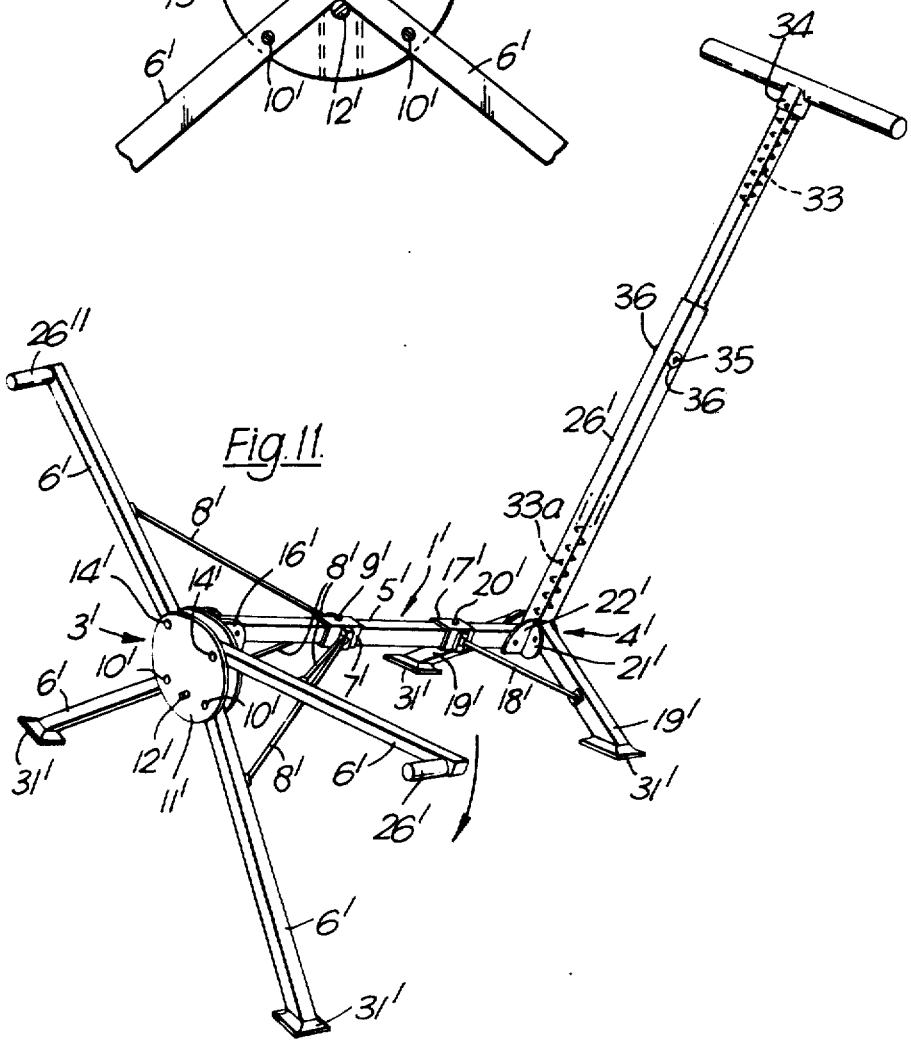
FIG. 11 is a perspective view of a modified collapsible chair according to the present invention in its erected position with the flexible seat removed.

With reference now to FIG. 11, the bracing frame generally indicated at 1' comprises two articulated assemblies, a front assembly 3' and a rear assembly 4. The front and rear assemblies are connected by an elongated tubular support 5'.

In the improved construction of the front articulated assembly 3' four tubular arms 6' are moved to their erected position by an umbrella mechanism comprising a sleeve 7' having four struts 8' with one strut connecting each arm 6' to the sleeve 7' by universal joints at each end of the strut. The sleeve 7' is held in its extreme position along the elongated tubular support 5' by a spring loaded catch 9'.

Figure 12:
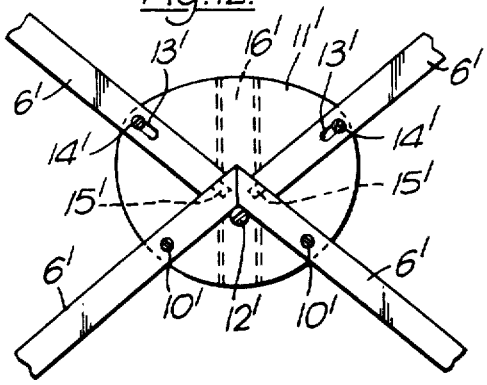
FIG. 12 is an enlarged detail fragmentary view of the improved front articulated assembly in its erected position.

The front assembly 3' has a modified arrangement to lock the arms in their erected positions as illustrated in FIG. 12. In this construction the lower arms 6' which form the legs of the chair frame, pivot about pins 10' in plates 11' and are swung outwardly until engage a central pin 12'. The two upper arms 6' are provided with slots 13' which are located on pins 14' about which they can slidably pivot. At the inner ends, the two upper arms 6' have spigots 15' which are located in holes provided in the lower arms 6', when in their erected position. Such an arrangement can be readily erected or collapsed by sliding the pins 14' in the slots 13' of the upper pair of arms 6' to insert or remove the spigots 15' respectively from the holes in the lower pair of arms. To stow the arms 6' they swing downwards about their pivot pins 10' and 14' and the plates 11' pivot about bracket 16' to stow the arms alongside the tubular support 5'.

In a similar construction the rear articulated assembly 4' can be erected by means of an umbrella mechanism comprising a sleeve 17' and two struts 18' which are connected at their respective ends by universal joints to the sleeve 17' and the legs 19'. Thus by sliding the sleeve towards the rear assembly 4' the legs 19' are swung outwardly to their erect position. The sleeve 17' is provided with a spring loaded catch 20' to lock the sleeve in its extreme positions.

Figure 13:
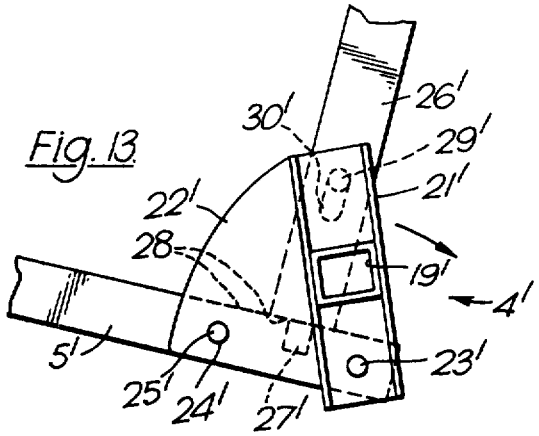
FIG. 13 is an enlarged fragmentary view of an improved rear articulated assembly in its erected position.
Figure 14:
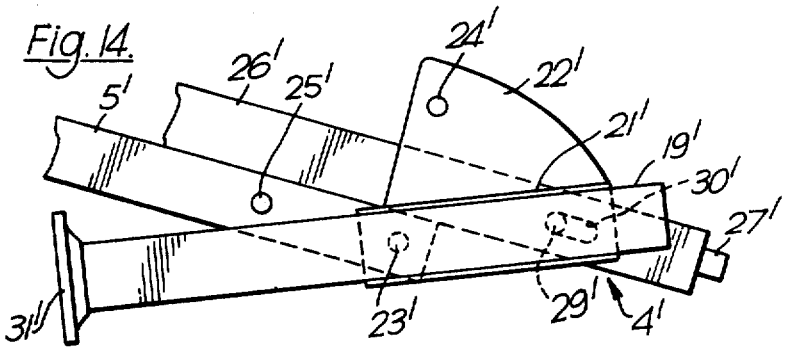
FIG. 14 is an elevational view of the assembly of FIG. 13 in its collapsed position.

Another modification of the rear assembly is to pivot the brackets 21' together with the side plates 22' as shown in FIGS. 13 and 14. The brackets 21' which carry the pivotably mounted legs 19' are secured to the side plates 22' respectively which are in turn pivotably mounted about pivot pin 23' to the end of the elongated tubular support 5'. The plates 22' are quadrant shaped and have holes 24' which engage spring loaded catches 25' projecting at each side of the tubular support 5' which catches are chamfered to facilitate the automatic latching of the catches in their respective holes.

In place of the angular adjusting means of the tubular member, the tubular member 26' of the present embodiment, see FIGS. 13 and 14 has a projecting spigot 27' at its lower end which can be located in one of two holes 28' in the elongated tubular support 5'. By raising the member 26' and pivoting it about pivot 29' in the side plates 22', the member 26' can be adjusted to an upright or an inclined position. To collapse the frame the member 26' is raised sliding the pivot 29' in a slot 30' formed in the member 26', the spigot 27' can be removed from its respective hole and the elongated tubular member is swung to a position alongside the support 5', see FIG. 14.

The front and rear legs of the chair are provided with feet 31' which are rectangular shaped inserts of a hard plastics material. These provide a firm base to prevent the legs of the chair from sinking into the ground for example, when the chair is used on a soft lawn or to prevent the ends of the legs from marking a floor surface when the chair is used in doors.

Figure 16:
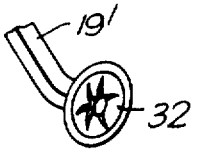
FIG. 16 is a fragmentary view of a wheel for attachment to the collapsible chair to convert it into a wheelchair.

In a modified construction the lower ends of the legs are bent outwardly and provided with internal bushes and spindles on which wheels 32 are rotatably mounted, see FIG. 16, the collapsible chair can thereby be converted into a wheel chair. It has been found that if the chair is modified as a wheel chair there is the tendency for the passenger being carried to be jolted when the chair is wheeled over an uneven surface or when traversing a roadside kerb. To alleviate any jolting or jarring the elongated tubular member 26' may be provided with spring 33 see FIG. 11, which is located between a T-shaped support 34 on which the flexible seat (not shown) is hung and a spring loaded catch 35 secured in the lower telescopic member of the elongated tubular member 26'. It will be seen that any jolting or jarring from the wheels and the supporting legs is dampened by the spring and does not get transmitted to the flexible seat. This spring arrangement is particularly important at the rear wheels of the chair if the passenger is suffering from an orthopaedic disability.

As an alternative the spring 33*a* shown in chain dotted line may be provided at the lower end of the telescopic member 26' the lower end of the spring being held against the spigot 27' while the upper end of the spring engages the upright of the T-shaped support 34.

Figure 15:
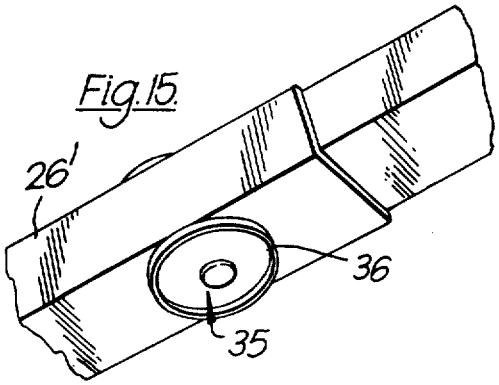
FIG. 15 is an enlarged detail of FIG. 11 showing a cover for a spring loaded detent.

The spring loaded catches 35 and 25' can be provided with a dimple shaped cover 36 as shown in FIG. 15, which is made of a flexible plastics material, and covers the projecting pins of the spring loaded catches. These covers, provide a comfortable cushion for applying finger pressure to release the catch.

In one embodiment of the collapsible chair the flexible cover (not shown) is secured to the upper arms 6' of the front assembly 3' by pins 26' which are removably located in holes at the outer ends of the arms 6'. These pins are located in pockets formed in the flexible seat.

The flexible seat can be of any suitable material such as canvas although a preferred material is a textile laminate made of polypropylene.

Figure 17:
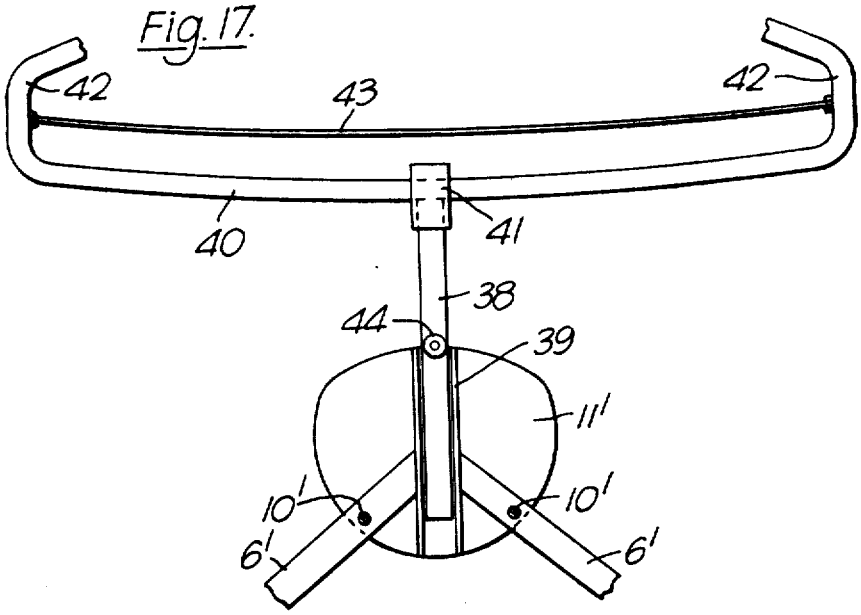
FIG. 17 is a fragmentary front elevational view of a modified front articulated assembly of the chair shown in FIG. 11 with a removable leg support and FIG. 18 is a similar view to FIG. 17 with the leg support removed and the articulated assembly in its collapsed or stowed position.
Figure 18:
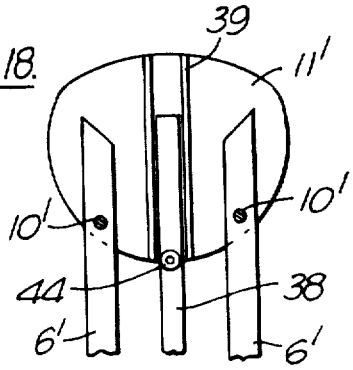

A modified construction of the front assembly is illustrated in FIGS. 17 and 18 in which the plates 11 are pivoted by bracket 16' (see FIG. 11) to the support 5', as described above, but the two upper arms 6 are replaced by a tubular upright 38 which slides in a channel 39 located between the two plates 11'. The two lower arms 6' are pivoted about pins 10' and have angled ends which engage the side walls of the channel 39 when in their erect position. At its upper end the upright 38 carries a cross-member 40 which is located on the upright by a collar 41 The ends of the cross-member 40 are bent upwardly and receive supports 42 for arm rests. An elastic leg support 43 extends between the ends of the cross member 40 to which the front of the flexible seat can be attached.

To dismantle the cross member the collar 41 is removed from the upright 38 and a stop 44 on the upright is pressed releasing the upright so that it can slide downwardly in the channel 39, as shown in FIG. 18. The arms 6' are folded downwards and the plates 11' are pivoted by bracket 16' so that the arms 6' and upright 38 lie alongside the elongated tubular support 5'.

Various other modifications may be made to the chair of the present invention, for example, instead of the above described adjustment of the elongated tubular member to incline the back of the flexible seat, the spigot 27' and holes 28' can be replaced by an infinitely adjustment mechanism comprising a threaded screw and nut. The nut would replace the spigot and the screw would be located on the elongated tubular support 5'. The relative angle of the member 26' to the support 5' can thereby be set at an infinitely variable angle by rotating the nut or the screw.

When the chair is adapted for use as a wheel chair the adjustment of the inclination of the seat is only possible by unseating the passenger to adjust the angle of the member 26'. In a further modification it is envisaged to provide a spring loaded pedal operated plate, on the support 5' below the member 26', which plate would releasably engage the spigot at the end of the member 26'. The spigot would be spring-loaded so that by pressing down on the pedal the plate would be raised engaging the spigot and disengaging it from one of a plurality of the holes in the support 5'. Thus, without unseating the passenger the pedal can be operated to relocate the position of the spigot in the required one of the holes and thereby adjust the angle of the member 26' and the flexible seat.

I claim:

1. A portable collapsible chair comprising a bracing frame and a separate flexible seat removably attached to the bracing frame in which the frame is readily pivotable from a folded position to an erected position for attachment of the flexible seat to support and brace the flexible seat clear of the ground surface on which the chair is supported, wherein the bracing frame comprises two articulated assemblies connected by an elongated tubular support, a first articulated assembly, forming the front of the chair, comprising a center bracket interconnected to said elongated tubular support for movement between a first folded position alongside said tubular support and a second extended position, four arms pivotally connected to said bracket for movement through a common plane when said bracket moves from the folded position lying alongside the elongated tubular support to the extended position wherein two of the arms extend radially upward from the center bracket to form seat supports and the other two arms extend radially downward to form legs and a second articulated assembly, forming the back of the chair, comprising an elongated tubular member and at least two support legs at the lower end thereof, which legs are pivotable from a folded position, lying alongside the elongated tubular support, to an extended position projecting downwardly from the two tubular members, said flexible seat removably attached to the two upwardly extending arms of the first articulated assembly and to the upper end of the elongated tubular member of the second articulated assembly.

2. A chair according to claim 1 in which the elongated tubular member is formed by telescopically arranged tubular members which can be locked in one or more extended positions.

3. A chair according to claim 1 in which the elongated tubular support is formed by telescopically arranged tubular members enabling the length thereof to be adjusted and locked in one or more extended positions.

4. A chair according to claim 1 in which the articulated assembly, at the rear of the bracing frame, includes a bracket, at the joint of the articulated members, having an arcuate surface formed with a plurality of notches wherein a projecting stud or studs can be releasably located to adjust the angular position of the elongated tubular member relative to the elongated tubular support.

5. A chair according to claim 4 in which the upper end of the elongated tubular member is provided with a cross member for supporting the upper end of the flexible seat.

6. A chair according to claim 5 in which the cross member is fixed to a cap removably located over the free end of the elongated tubular member so that it can be removed with the flexible seat and rolled up for storage.

7. A chair according to claim 1 in which the edge of the flexible seat to be secured at the front of the bracing frame is provided with a reinforcing web or strip which is formed with pockets at its ends to slip over projections at the free ends of the upper two of the four arms, when in their erected position.

8. A chair according to claim 4 in which a carrying handle is provided at the opposite end of the elongated tubular member to the articulated joint.

9. A chair according to claim 1 in which the flexible seat comprises a sheet of canvas material formed with tubular pockets for slipping over the bracing frame.

10. A chair according to any of claims 1 or 2 in which the legs of the bracing frame are provided with wheels to convert the chair into a wheel chair.

11. A chair according to claim 1 in which the four arms of the front articulated assembly are automatically moved to an erect position by an umbrella mechanism comprising a sleeve slidable along the elongated tubular support, and four struts connected one to each arm, each strut having universal joints at its free ends to connect it to the sleeve and arm respectively.

12. A chair according to claim 1 in which the rear articulated assembly is provided with an umbrella mechanism comprising a sleeve slidable along the elongated tubular support with two struts, having universal joints at their free ends, by means of which they are connected to the sleeve and two legs respectively.

13. A chair according to claim 1 in which the two lower arms of the front articulated assembly are pivoted on pins to said center bracket comprising two plates, the ends of the arms being chamfered so that in their erect position they abut and rest on a central pin, the two upper arms each being slotted and pivoted by the slot on a pin located between the two plates, the inner ends of the upper arms each having a spigot which is engageable in a hole formed in an arm lying below the upper arm.

14. A chair according to claim 4 in which the arcuate bracket of the rear articulated assembly has legs pivotably secured to the outer sides thereof, the bracket being pivoted to the rear end of the elongated tubular support and having holes which latch with spring loaded catches projecting from the tubular support to lock the bracket and legs in an erect position, the elongated tubular member having a slot for engaging a pin between the sides of the arcuate bracket, and a spigot at its lower end to engage one of a plurality of holes formed in the elongated tubular support to adjust the rake of the back of the chair.

15. A chair according to claim 1 in which in the front articulated assembly the upper two arms are replaced with a T-shaped leg support, having a collar removably located on an upright, the upright being slidably located in a channel member between the two plates of the assembly.

16. A chair according to claim 15 in which the T-shaped leg support has upwardly bent ends which receive supports for arm rests, an elastic strip being stretched between these supports to provide a leg rest.

17. A chair according to claim 14 in which the spring catches of the bracing frame have dimple shaped plastics material covers to facilitate operation of the catches to release the frame members.

18. A chair according to claim 16 in which spring means are incorporated in the elongated tubular member between the T-shaped member from which the flexible seat is hung and the lower part of the elongated tubular member to dampen any jolting or jarring transmitted from the wheels when the chair is adapted to a wheel-chair.

* * * * *